United States Patent [19]

Heard

[11] Patent Number: 4,498,255

[45] Date of Patent: Feb. 12, 1985

[54] PICTURE FRAMES

[76] Inventor: Malcolm G. Heard, P.O. Box 6662, Roggebaai, 8012, Cape Town, Cape Province, South Africa

[21] Appl. No.: 497,936

[22] Filed: May 25, 1983

[30] Foreign Application Priority Data

May 25, 1982 [ZA] South Africa ..... 82/3629

[51] Int. Cl.[3] ..... A47G 1/06

[52] U.S. Cl. ..... 40/156; 40/13; 40/152; 40/157

[58] Field of Search ..... 40/156, 155, 13, 152, 40/14, 16.6, 157; 52/401, 768, 769

[56] References Cited

U.S. PATENT DOCUMENTS

| | | | |
|---|---|---|---|
| 2,882,633 | 4/1959 | Howell | 40/156 |
| 2,979,842 | 4/1961 | DeRidder | 40/13 |
| 3,205,601 | 9/1965 | Gawne et al. | 40/156 |
| 3,254,438 | 6/1966 | Filary et al. | 40/156 |
| 3,310,901 | 3/1967 | Sarkisian | 40/156 |
| 3,386,198 | 6/1968 | Howell | 40/156 |
| 4,138,787 | 2/1979 | Sarkisian et al. | 40/618 |
| 4,145,828 | 3/1979 | Hillstrom | 40/156 |
| 4,237,632 | 12/1980 | Segerstad | 40/156 |

*Primary Examiner*—Robert Peshock
*Assistant Examiner*—Cary E. Stone
*Attorney, Agent, or Firm*—Karl W. Flocks; Sheridan Neimark

[57] ABSTRACT

A picture frame comprises a base frame composed of base frame members which base frame can be mounted on a wall or other surface. The picture frame also includes four elongate members which are pivotally mounted on the base frame members. Each of the members is displaceable between an operative position in which a bearing face thereof bears down on the picture P to grip it between itself and the flange of the base frame member and a released position in which the bearing face is spaced from the flange. A leaf spring holds the member in that one of the positions to which it has been displaced. Once the edges of the picture have been placed against the four flanges the members are returned to their operative positions in which they grip the four edges of the picture between their bearing faces and the flanges.

14 Claims, 4 Drawing Figures

PICTURE FRAMES

This invention relates to picture frames.

According to the present invention there is provided a picture frame comprising a base frame including a flange which a picture placed in the frame contacts, a plurality of picture retaining members mounted on the base frame, each of said members including a picture engaging face and being mounted on the base frame for movement between an operative position in which said face thereof is adjacent said flange and an inoperative position in which said face thereof is spaced from said flange, and spring means for urging said members to their operative positions so that the members grip a picture in the frame between themselves and said flange.

Said base frame can comprise a plurality of base frame members, said retaining members being pivotally mounted on said base frame members. In this form, said retaining members are preferably mounted on the base frame members by connecting structures each of which comprises a groove in one of the members which groove is more than semi-circular in cross-section and a bead on the other of said members, the bead being in the groove and also being more than semi-circular in circumferential extent whereby the bead is only separable from the groove by a sliding movement along the groove. It is desirable for the groove to be in the frame member and for the bead to be part of the retaining member.

In a specific constructional form, each of said base frame members comprises a wall which forms part of the outer boundary of the frame, a first flange structure protruding from said wall on one side thereof, the portion of the first flange structure remote from said wall constituting part of said flange, a second flange structure protruding from said wall on the same side thereof as the first flange structure, the second flange structure being narrower, measured from said wall, than said first flange structure, the first and the second flange structures defining a mouth, the retaining member associated with that frame member extending through said mouth and the end of the part of the retaining member which lies outside the mouth having said face thereon, the retaining member being pivotally mounted on the first flange structure at a position between said wall and said flange.

Each spring means can comprise a leaf spring carried by the base frame, each leaf spring bearing on one of the retaining members to urge it into its operative position. Where leaf springs are used each can be arranged generally tangentially to the axis about which the associated retaining member pivots, the arrangement being such that the leaf spring is progressively deflected as the retaining member moves away from its operative position or moves away from its inoperative position until a centre position has been passed whereupon the spring urges the retaining member towards the other of its positions. Furthermore, each leaf spring is preferably formed with two depressions each of which is capable of receiving a portion of the retaining member, said portion being seated in one or other of the depressions while the retaining member is in its operative or inoperative position.

The leaf spring or springs associated with each base member can be in the hollow interior of the base member which is bounded by the flange structures and by said wall, the flange structures being formed with slits extending in the direction of elongation of the frame member for receiving the edges of the leaf spring or springs.

For a better understanding of the present invention, and to show how the same may be carried into effect, reference will now be made, by way of example, to the accompanying drawings in which.

Figure 1:
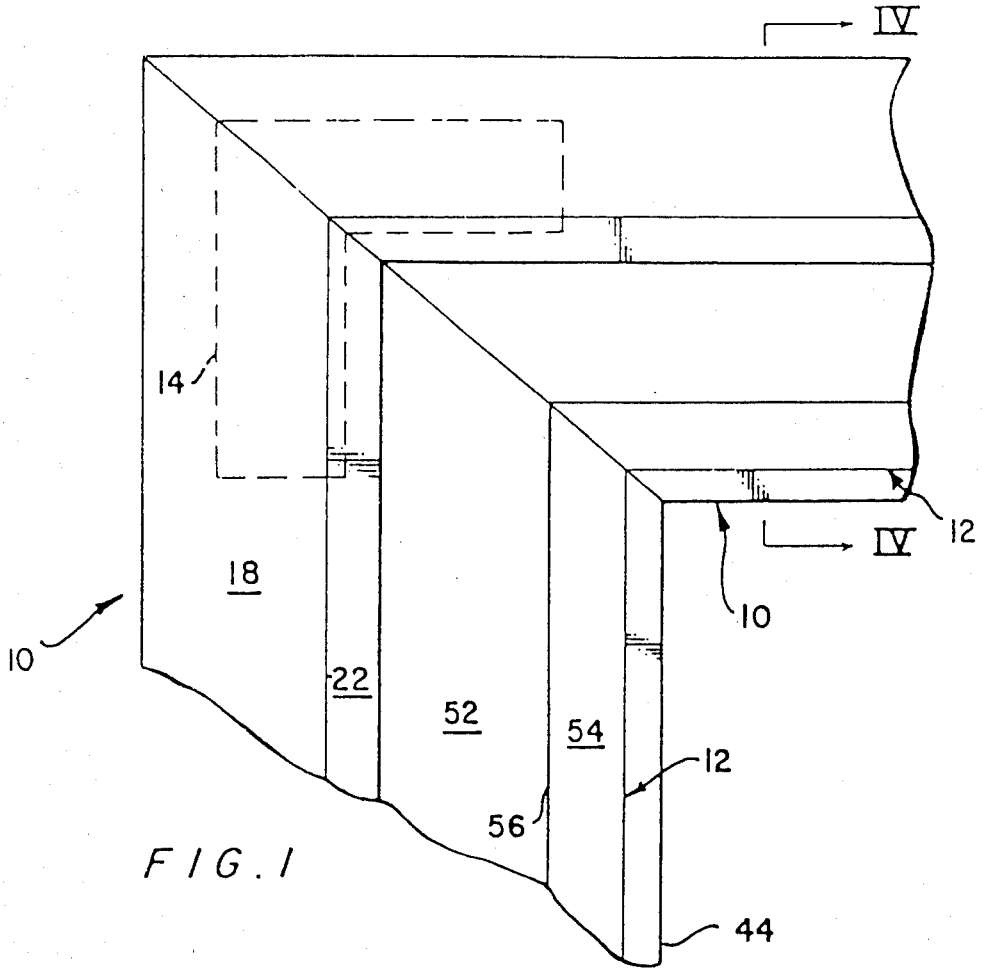
FIG. 1 is a front elevation of a corner part of a picture frame.

In FIG. 1 one of the four corner portions of a picture frame is illustrated, the frame being rectangular although other shapes are possible. The illustrated portion of the frame comprises two base frame members 10, two picture retaining members 12 and a connector 14. To complete the rectangular frame there are two more members 10, two more members 12 and three more connectors 14.

Figure 2:
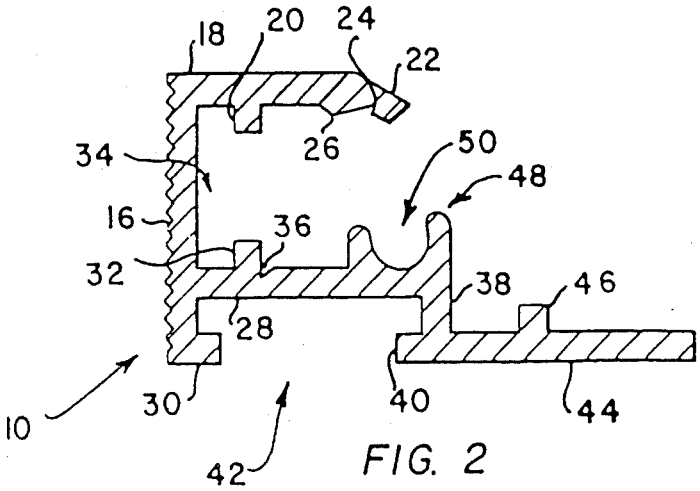
FIG. 2 is a section through a base frame member of the picture frame of FIG. 1.

Each base frame member 10 is cut from an extrusion which is preferably of aluminium but can be of synthetic plastics material, the section of the extrusion being illustrated in FIG. 2.

The base frame member 10 of FIG. 2 has a side wall 16 which forms part of the outer boundary of the frame and which can be decorated on the outer face thereof. In the illustrated embodiment the decoration comprises a series of ridges alternating with a series of valleys. A flange structure 18 joins the wall 16 along one edge thereof, there being a rib 20 on the inner face of the flange structure 18. The edge portion 22 of the flange structure 18 is at a slight inclination with respect to the remainder of the flange structure 18. Where the portion 22 joins the remainder of the flange structure 18, there is a slit 24 and a protrusion 26.

Parallel to, and spaced from, the flange structure 18 is a second flange structure 28. The wall 16 protrudes downwardly beyond the flange structure 28, a lip 30 of rectangular cross section protruding from the part of the wall 16 which is below the flange structure 28. A rib 32 projects from the flange structure 28 towards the rib 20. The ribs 20 and 32 together with part of the wall 16 and parts of the flange structures 18 and 28 define an elongate cavity 34.

A slit 36 is provided in the face of the flange structure 28 immediately adjacent the rib 32.

A short wall 38 extends downwardly from the flange structure 28 at a position remote from the wall 16, the short wall 38 being parallel to the wall 16 and having a lip 40 therealong. The lips 30 and 40, wall 38, flange structure 28 and wall 16 together define an elongate cavity 42 the shape of which is very similar to that of the cavity 34.

The flange structure 28 includes a flange 44 which protrudes from the short wall 38 in the opposite direction to the lip 40 and comprises a stop rib 46 on one face thereof. A bead generally indicated at 48 extends along the flange structure 28 on the side thereof opposite to the wall 38 and is formed with a groove 50 which is slightly more than semicircular in section. The flange structure 18 is narrower, measured from the wall 16, than the structure 28. The groove 50 is between the wall 16 and the flange 44.

Figure 3:
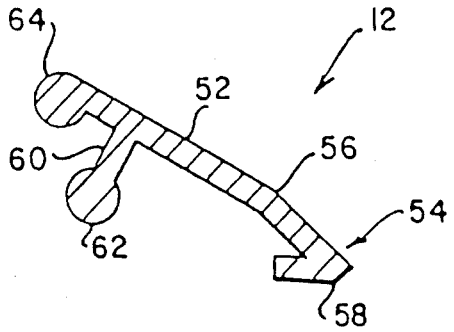
FIG. 3 is a section through a picture retaining member.

Each picture retaining member 12 of the picture frame is of the form illustrated in FIG. 3. Each member 12 includes a main portion 52 and an end portion 54, there being a slight change in direction at 56 where the portions 52 and 54 merge. The portion 54 is thickened to form a bearing face 58. A rib 60 protrudes from the main portion 52 and a part circular mounting bead 62 is provided on the free edge of the rib 60. A similar bead 64 is formed along the edge of the portion 52 remote from the portion 54. The bead 64 has a locking function as will be described hereinafter.

Figure 4:
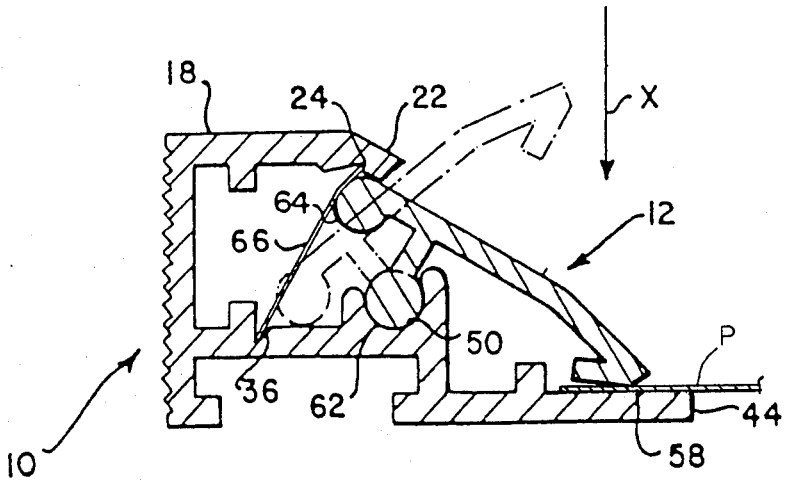
FIG. 4 is a section showing the member of FIG. 3 mounted on the base frame of FIG. 2, the section being on the line IV—IV of FIG. 1.

FIG. 4 illustrates the manner in which the picture retaining member 12 of FIG. 3 is mounted on the base frame member 10 of FIG. 2. It will be noted that the bead 62 is in the groove 50, the bead 64 lying adjacent the portion 22. The bearing face 58 lies adjacent the flange 44. Also shown in FIG. 4 is a leaf spring 66 of elongate rectangular form, the ends of the leaf spring 66 being in the slits 24 and 36. As will be seen from this Figure, the end face of the bead 64 bears permanently on the leaf spring 66 and slightly deforms it so that there is a continuous holding force acting on the member 12.

To assemble a picture frame of the form shown in FIG. 1, four base frame members 10 shown in FIG. 2, four members 12 (FIG. 3), four connectors 14 and eight or more leaf springs 66 are used. Four right angled connectors 14 can be placed as shown in FIG. 1 in the cavities 42 of adjacent extrusion lengths and secured by self-tapping screws to the flange structure 28. In addition, if desired, other right angled connectors (not shown) can be pushed into the cavities 34. If such connectors are used, they are push fits in their cavities and are not secured to the base frame members 10 by screws as these would mar the appearance of the wall 16. As each pair of base frame members are connected together to form the base frame, the members 12 and leaf springs 66 are slid into the grooves 50 and slits 24, 36 respectively. The members 12 protrude through the mouth defined between the flange structures. The ends of the members 12 and base frame extrusions can be mitred at 45 degrees as shown in FIG. 1 to provide aesthetically acceptable corners. The members 12 are desirably sufficiently long to terminate close to one another, but should not overlap and interfere with one another.

The four flanges 44 together form a flange extending around the entire periphery of the frame on the inside thereof.

Once the frame is assembled, the leaf springs 66 hold the bearing faces 58 against the flanges 44. By inserting an instrument such as a screwdriver between each face 58 and the associated flange 44, each member 12 can be turned about the common axis of its bead 62 and the associated groove 50. Initially, each leaf spring 66 is further deformed as the associated member 12 turns, the bead 64 swinging in an arc about said common axis and the leaf spring lying on a chord of that arc. As the bead 64 reaches the centre of the leaf spring 66, there is an overcentre action and the member 12 snaps into the position shown in the chain dotted lines in FIG. 4. In this position the spring 66 is still slightly deformed and thus the member 12 is positively held in its open position.

The picture to be mounted in the frame, together with a backing sheet and a protective transparent cover if desired, can then be placed against the peripheral flange constituted by the flanges 44. The picture, its backing sheet and protective layer are generally designated P in FIG. 4. It will be noted that, in pivoting from the full line position shown to the chain dotted line position shown, the portion 54 moves towards the outer edge of the frame, that is, the edge constituted by the wall 16. Thus it does not obstruct the picture as it is placed in the frame, movement of the picture being in the direction of the arrow X in FIG. 4. Lateral movement of the picture P is limited by the stop ribs 46.

To secure the picture, it is merely necessary to return each member 12 to the full line position illustrated in FIG. 4 by pressing down on the portion 54. The bead 64 initially deflects the leaf spring 66 further until the over centre action comes into play whereupon the member 12 snaps back to the full line position illustrated with the face 58 bearing down on the picture.

The frame described is specifically, but not exclusively, intended for use in displaying advertising pictures. Such pictures are frequently changed and the 'quick-release' ability of the described frame makes it particularly suitable for this purpose.

If desired, a leaf spring with two spaced depressions for receiving the bead 64 can be used.

I claim:

1. In a picture frame, a structure comprising a base frame member having a wall which forms part of the outer boundary of the frame and first and second spaced flange structures protruding from said wall, said flange structures defining a mouth constituting the entrance to the interior of said frame member, and said first flange structure protruding beyond the second flange structure to provide a flange which forms a backing for an edge zone of a picture, a picture retaining member pivotally mounted on said first flange structure, said retaining member extending through said mouth thereby to provide a first portion which is within the interior of the frame member and a second portion which lies externally of said interior, said second portion including a picture engaging face for gripping a picture between itself and said flange, and said first portion including an end face which swings in an arc when said retaining member is displaced about its pivotal mounting, and a leaf spring in said interior and spanning between said flange structures, said end face bearing on the leaf spring which lies along a chord of the arc along which said end face moves whereby the leaf spring is increasingly deformed and then allowed to relax as said picture retaining member is displaced about its pivotal mounting from either of its end positions.

2. A structure according to claim 1, wherein said retaining member comprises a first part which has said faces at opposite ends thereof and a lateral extension the free end of which is formed with a first pivotal mounting element, said first flange structure being formed with a co-operating second pivotal mounting element by means of which elements said retaining member is pivotally mounted.

3. A structure according to claim 2, in which one of said pivotal mounting elements has therein a groove which groove is more than semi-circular in cross-section and the other of said elements is a bead, the bead being in the groove and also being more than semi-circular in circumferential extent whereby the bead is only separable from the groove by a sliding movement along the groove.

4. A structure according to claim 3, in which the groove is in said second element and the bead forms part of the first element.

5. A structure according to claim 2, in which the flange structures are formed with slits extending in the direction of elongation of the frame member for receiving the ends of the leaf spring.

6. A structure according to claim 1, in which the flange structures are formed with slits extending in the direction of elongation of the frame member for receiving the ends of the leaf spring.

7. In a picture frame, a structure comprising a base frame member having a wall which forms part of the outer boundary of the frame and first and second spaced flange structures protruding from said wall, said flange structures defining a mouth constituting the entrance to the interior of said frame member, and said first flange structure protruding beyond the second flange structure to provide a flange which forms a backing for an edge zone of a picture, a picture retaining member pivotally mounted on the frame member, said retaining member extending through said mouth thereby to provide a first portion which is within the interior of the frame member and a second portion which lies externally of said interior, said second portion including a picture engaging face for gripping a picture between itself and said flange, and said first portion including an end face which swings in an arc when said retaining member is displaced, about its pivotal mounting, between two end positions one of which is an operative picture gripping position and the other of which is an inoperative position to which it is displaced when a picture is to be mounted on or removed from the frame, and a leaf spring in said interior and spanning between said flange structures, said leaf spring lying along a chord of the arc along which said end face moves, and said end face bearing on the leaf spring in both said end positions thereby to deform the leaf spring and to provide forces which hold said retaining member in both said retaining end positions.

8. A structure according to claim 7, in which said retaining member is pivotally mounted on said first flange structure.

9. A structure according to claim 8, in which the flange structures are formed with slits extending in the direction of elongation of the frame member for receiving the ends of the leaf spring.

10. A structure according to claim 8, wherein said retaining member comprises a first part which has said faces at opposite ends thereof and a lateral extension the free end of which is formed with a first pivotal mounting element, said first flange structure being formed with a co-operating second pivotal mounting element by means of which elements said retaining member is pivotally mounted.

11. A structure according to claim 10, in which the flange structures are formed with slits extending in the direction of elongation of the frame member for receiving the ends of the leaf spring.

12. A structure according to claim 10, in which one of said pivotal mounting elements has therein a groove which groove is more than semi-circular in cross-section and the other of said elements is a bead, the bead being in the groove and also being more than semi-circular in circumferential extent whereby the bead is only separable from the groove by a sliding movement along the groove.

13. A structure according to claim 12, in which the groove is in said second element and the bead forms part of the first element.

14. A structure according to claim 7, in which the flange structures are formed with slits extending in the direction of elongation of the frame member for receiving the ends of the leaf spring.

* * * * *